US005566440A

United States Patent [19]

Schoormans et al.

[11] Patent Number: 5,566,440

[45] Date of Patent: Oct. 22, 1996

[54] METHOD FOR THE FABRICATION OF AN OUTFLOW ELEMENT

[75] Inventors: Johannes A. H. M. Schoormans, Waalre; Dirk Van der Net, Eersel, both of Netherlands

[73] Assignee: Johannes A. Schoormans, Waalre, Netherlands

[21] Appl. No.: 446,653

[22] PCT Filed: Oct. 7, 1993

[86] PCT No.: PCT/NL93/00197

§ 371 Date: May 25, 1995

§ 102(e) Date: May 25, 1995

[87] PCT Pub. No.: WO94/09225

PCT Pub. Date: Apr. 28, 1994

[30] Foreign Application Priority Data

Oct. 15, 1992 [NL] Netherlands ..... 9201790

[51] Int. Cl.[6] ..... B21D 39/00

[52] U.S. Cl. ..... 29/507; 29/506; 29/523

[58] Field of Search ..... 29/506, 507, 523; 285/196, 200, 222

[56] References Cited

U.S. PATENT DOCUMENTS

| | | | |
|---|---|---|---|
| 35,691 | 6/1862 | Knickerbocker | 29/523 |
| 943,117 | 12/1909 | Lucas et al. | 29/523 |
| 1,532,897 | 4/1925 | Hirschstein . | |
| 1,999,277 | 4/1935 | Boosey . | |
| 3,994,005 | 11/1976 | Maloney, Jr. et al. . | |
| 4,213,323 | 7/1980 | De Deugd . | |
| 4,333,672 | 6/1982 | Arthur et al. . | |
| 4,334,703 | 6/1982 | Arthur et al. . | |
| 4,779,899 | 10/1988 | Williams . | |
| 4,934,038 | 6/1990 | Caudill | 29/523 |

FOREIGN PATENT DOCUMENTS

| | | | |
|---|---|---|---|
| 0442313 | 8/1991 | European Pat. Off. . | |
| 0502493 | 9/1992 | European Pat. Off. . | |
| 985930 | 7/1951 | France | 29/523 |
| 1084084 | 1/1955 | France . | |
| 1348220 | 1/1964 | France . | |
| 148570 | 5/1902 | Germany . | |
| 306660 | 9/1916 | Germany . | |
| 1955319 | 5/1971 | Germany . | |
| 2163863 | 6/1973 | Germany . | |
| 8813483 | 12/1988 | Germany . | |
| 170337 | 10/1921 | United Kingdom . | |
| 505677 | 5/1939 | United Kingdom | 29/523 |

*Primary Examiner*—David P. Bryant
*Attorney, Agent, or Firm*—Pennie & Edmonds

[57] ABSTRACT

A process for fabricating an outflow element for the drainage of rain-water containing a lead plate having a hole and an aluminum outlet pipe having an end sealingly affixed in the hole, whereby the end of the outlet pipe contains a plurality of bulges and the plate has a collar at the hole, which, with the aid of a clamping tube contacting the end of the pipe in question, keeps the collar in pressing contact with the bulges. The other end of the clamping tube is equipped with an external circumferential groove, within which an O-ring is to be applied to facilitate sealing with drainage pipes to be connected thereto. The fabrication process uses a widening tool to deform the collar and press the clamping tube into the end of the pipe. Alternatively, the fabrication can also occur by bringing the clamping tube into the collar and subsequently stretching the diameter of the clamping tube so that the clamping tube pushes the collar into the bulge.

2 Claims, 3 Drawing Sheets

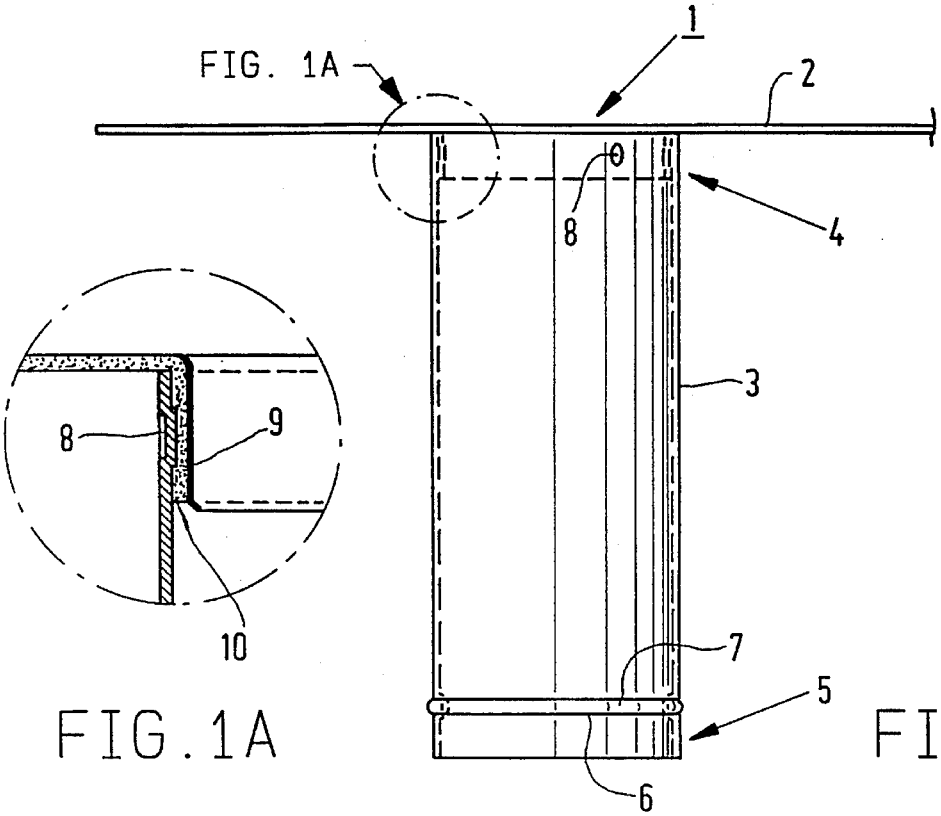
FIG.1A
FIG.1
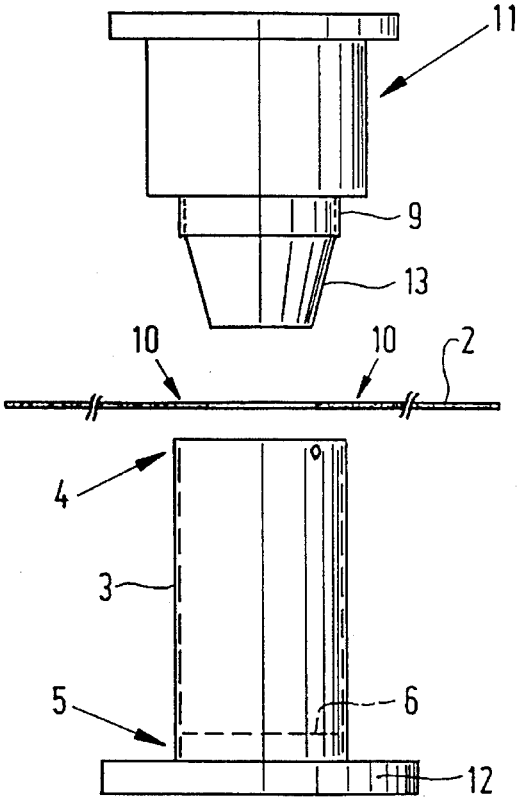
FIG.2

METHOD FOR THE FABRICATION OF AN OUTFLOW ELEMENT

TECHNICAL FIELD

The invention pertains to a method for the fabrication of an outflow element, which outflow element is composed of an outlet pipe possessing two or more bulges projecting inwardly, a plate equipped with a hole with a diameter which is smaller than the diameter of the outlet pipe, and a clamping tube to be permanently fixed together.

The invention further pertains to a method for the fabrication of an outflow element, which outflow element is to be composed of an outlet pipe equipped at one end with a bluge projecting outwardly which is protruding from the entire circumference of the outlet pipe, a plate equipped with a hole and a protruding collar along the circumference of the hole, whereby the external diameter of the collar is approximately the same as the internal diameter of the outlet pipe, and a clamping tube to be permanently fixed together.

BACKGROUND OF THE INVENTION

Outflow elements, or lower outlet pipes, are in part used to drain rain-water from flat roofs and typically into a sewer system.

Many of the outflow elements are fabricated from a lead plate within which a hole for the affixation of the end of a lead pipe has been made. By means of soldering or welding with the aid of lead, the pipe is sealed in a water-tight manner to the hole and the other end of the pipe is connected via an adapter to the drainage pipes, which drainage pipes are usually fabricated from PVC. Outflow elements having a single moulded lead entity are also known. Further, outflow elements made from other materials are known, such as those having a plate of the roof-covering material and a stainless steel outlet pipe, which plate and outlet pipe are sealed together in a mechanical manner. In general, the lead plate can be modified to the contours of the roof in situ by hand or with the use of light tools, and subsequently covered with a suitable roof-covering.

The known method suffers from the disadvantage, in particular in the in-situ situation where the outflow element is affixed to the roof, that it is laborious and furthermore requires the usage of heavy lead plates and tools which must be brought to the place of work in question and cut to size there. The prior making of one or more outflow elements in a workshop results later, as a consequence of the transport thereof, in a lack of roundness namely in the other extreme of the pipe, whereby the connection with the drainage pipes to the sewer leaves much to be desired, and this cannot be made air-tight and odour-tight without the use of extra means of assistance.

From the European patent application EP-A-502493 a device for floor drains is known. This device has a remodellable plate with a hole, an outlet pipe and a clamping tube. The plate and the outlet pipe are first coupled during fabrication of the device by a clamping tube in the form of a round bar spring. This bar spring must be compressed before use and then positioned properly.

SUMMARY OF THE INVENTION

The current invention aims to provide an improved method for the fabrication of such an outflow element, whereby the components of the outflow element are sealed to each other beforehand in a water-tight manner.

In accordance with the invention, the method for the fabrication of an outflow element composed of an outlet pipe possessing two or more bulges projecting inwardly, a plate equipped with a hole with a diameter which is smaller than the diameter of the outlet pipe, and a clamping tube permanently fixed together by:

placing the plate at an end of the outlet pipe;

placing the clamping tube on a partially cylindrical portion of a widening tool with a diameter greater than the hole diameter; and pressing a conical portion of the widening tool through the hole in the plate to the end of the outlet pipe, thereby widening and forming a collar around the hole and clamping the clamping tube to itself for pressing and holding the collar of the plate folded in the end of the outlet pipe to the bulges projecting inwardly.

In the fabrication of such an outflow element, the clamping tube does not have to be mounted during the forming of the collar; rather, the clamping tube can be pressed in to the collar at a later stage. In this manner, the demands on the form and the composite material of the clamping tube can be decreased, thereby permitting a clamping tube to be cut from a simple pipe. In this manner, the sizing accuracy of both the outlet pipe and the clamping tube are decreased, and a tolerance-insensitive construction arises to permit the clamping of plates of almost any desired thickness. The costs of fabrication and of materials for the clamping tube, and thus for the outflow element.

According to the invention, another method for the fabrication of an outflow element composed of an outlet pipe having a circumference and an internal diameter equipped at one end with a bulge projecting outwardly which is protruding from the entire circumference, a plate having a hole with a circumference and a protruding collar with an external diameter along the circumference of the hole, whereby the external diameter of the collar is approximately the same as the internal diameter of the outlet pipe, and a clamping tube all to be permanently fixed together, having the following steps:

placing the plate at an end of the outlet pipe, thereby contacting the collar and the end of the outlet pipe;

placing the clamping tube on a segmented tube in the collar at the position of the bulge in the outlet pipe; and stretching the diameter of the clamping tube by pushing a spline in the tube towards a second end of the pipe thereby enlarging the pipe diameter and clamping the clamping tube to press and hold the collar in an internal groove formed by the bulge in the outlet pipe can be considerably reuced in this manner.

The advantages of the methods according to the invention are that, in a simple manner, a completely produced outflow element is provided which meets all characteristics required in the profession in question. In particular, a well-clamped connection is created between the plate on the one hand and the outlet pipe on the other hand. An important advantage of this method is that a tolerance-insensitive method for the fabrication of the outflow element is provided. Because the clamping tube is stretched, close tolerances on the diameters of the outlet pipe and clamping tube are not required. Furthermore, with this method a plate of substantially desired thickness can be rigidly clamped.

BRIEF DESCRIPTION OF THE DRAWINGS

The invention and its further advantages will be further elucidated on the basis of the accompanying figures, wherein consistent reference numbers are used for the indication of one and the same element. The subjects of the figures are as follows:

FIG. 1 is a depiction of a first embodiment of the outflow element according to the invention, together with a detail of the specific connection between the re-modellable plate and the outlet pipe; FIG. 1A is an enlarged view of the collar area of the outflow element according to the invention;

FIG. 2 is a depiction of a first embodiment of the method according to the invention for the fabrication of the outflow element of FIG. 1;

DETAILED DESCRIPTION OF THE PREFERRED EMBODIMENT

Figure 3:
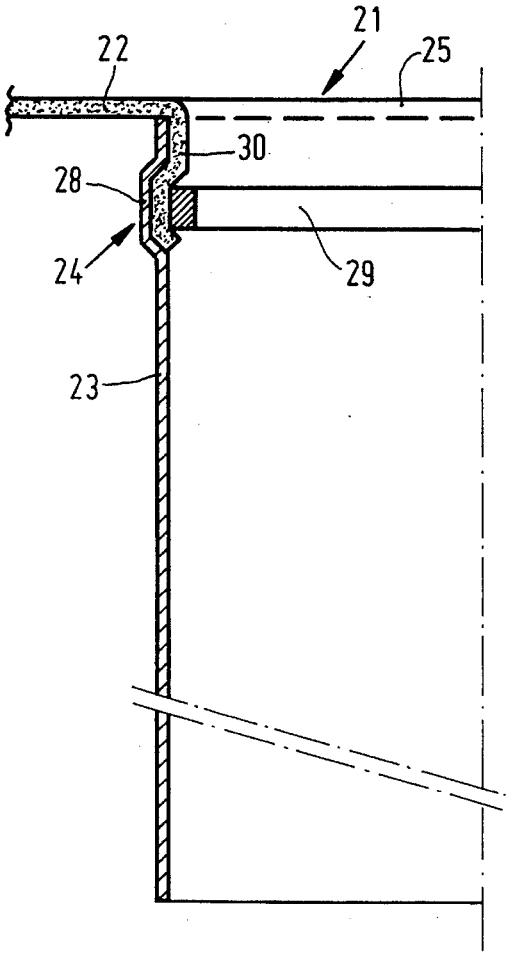
FIG. 3 is a depiction of a second embodiment of the outflow element according to the invention.

FIG. 1 depicts a first embodiment of the outflow element according to the invention. This finished outflow element 1 is constructed from an easily re-modeled plate 2 which is preferably made of lead and which is affixed to a so-called outlet pipe 3. The pipe is preferably constructed from a light material such as aluminum. The pipe 3 has a first end 4 and a second end 5. The end 5 is equipped with a circumferential brim 6 and in the depicted embodiment the circumferential brim 6 is implemented as a groove which is located on the outermost circumference of the end 5. An O-ring 7 is located in the groove 6, which O-ring 7 ensures a good sealing and connection to a non-depicted drainage pipe. Bulges 8 are introduced at the location of the first end 4 of the outlet pipe 3, one of which bulges 8 is depicted enlarged and in detail. In general, several bulges 8 are introduced at the end 4. In an embodiment which is not further explained, in place of the discrete bulges a continuous brim which protrudes on the inside of the end 4. However, discrete bulges 8 weaken the extreme 4 may be employed in question of the pipe 3 to a lesser extent.

A clamping tube 9 is located in the end 4, which clamping tube 9 clamps a folded collar 10 of the plate 2 to the bulges 8 as depicted in an enlarged fashion in FIG. 1A and in this way ensures a good clamping connection between the plate 2 and the pipe 3. The clamping tube 9 is preferably made from stainless steel.

The method for the fabrication of the outflow element 1 shall be further elucidated on the basis of FIG. 2. FIG. 2 depicts a widening tool 11, whereby the clamping tube 9 is mounted on a partially cylindrical portion of the widening tool. The pipe 3 which is cut to size during a rotating motion and wherein, preferably at the same time, the circumferential groove 6 is introduced in the end 5, is placed on a holder 12. The lead plate is located under the widening tool 11 close to the other end 4, which end is foreseen in the necessary bulges 8 beforehand, which lead plate is cut to size beforehand and contains a punched hole with a diameter less than the diameter of the aluminum pipe 3. In the lowering of the widening tool 11 on the pipe 3, in general with the aid of non-depicted hydraulic means, a conical portion 13 of the widening tool 11 causes a portion of the lead plate 2 to be folded down, giving rise to the internal collar 10. Upon further pushing through, the clamping tube 9 clamps itself in the end 4 and the final situation which is depicted in the detail of FIG. 1 is reached. In this manner, a permanent bond between the lead plate 2 and the aluminum pipe 3 is realised in a manner whereby welding and/or gluing, rolling or soldering in situ is no longer necessitated, and whereby, moreover, a currently customary adapter for the realisation of a connection between the pipe 3 and further drainage pipes becomes unnecessary. FIG. 3 depicts a second embodiment of the outflow element according to the invention. This outflow element 21 is also composed of an easily re-modellable plate 22 which is affixed to an outlet pipe 23 and which is equipped with a hole 25.

A bulge 28 is introduced at the location of an end 24 in the outlet pipe 23. This bulge is situated on the exterior surface of the outlet pipe 23 and protrudes from the entire circumference of the pipe.

A clamping tube 29 is located in the end 24, which clamping tube 29 clamps a folded collar 30 of the plate 22 in a groove formed by the bulges 28 and the interior wall of the pipe 23 and in this way ensures a good clamping connection between the plate 22 and the pipe 23. If desired, the inner wall of the pipe 23 can be roughened so as to be able to hold possibly thinner and more slippery plates to a suitable degree.

Figure 4:
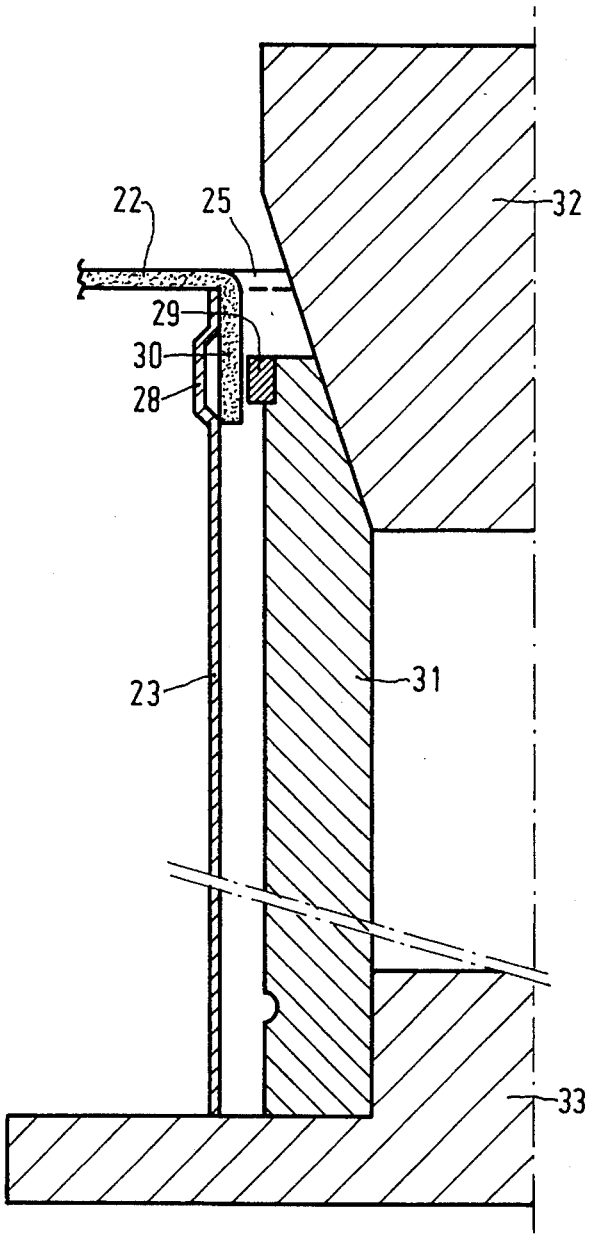
FIG. 4 is a depiction of a second embodiment of the method according to the invention for the fabrication of the outflow element of FIG. 3.

FIG. 4 will be used as a basis for the further elucidation of the method for the fabrication of the outflow element 21. The figure shows a segmented thick-walled tube 31 (for example in three or four equal-sized segments). The clamping tube 29 is located in a crevice in the tube 31. The clamping tube has an external diameter which is smaller than the diameter of the hole 25 in the plate 22. Moreover, the figure depicts a spline 32 and a support 33. During the downward motion of the spline 32 (in a direction which is towards the support) the spline pushes the segments of the tube 31 apart, whereby the clamping tube 29 is stretched in diameter. The clamping tube 29 then pushes the collar 30 in the groove formed by the bulge 28 whereby the collar is plastically deformed. After this action the clamping tube 29 has an external diameter which is larger than the diameter of the hole 25 and the external diameter of the collar 30 at the location of the bulge is larger than the internal diameter of the pipe 23.

The segments of the tube 31 are equipped with slanted edges so that the skittie-shaped spline 32 pushes the segments apart during its downward motion.

Figure 5:
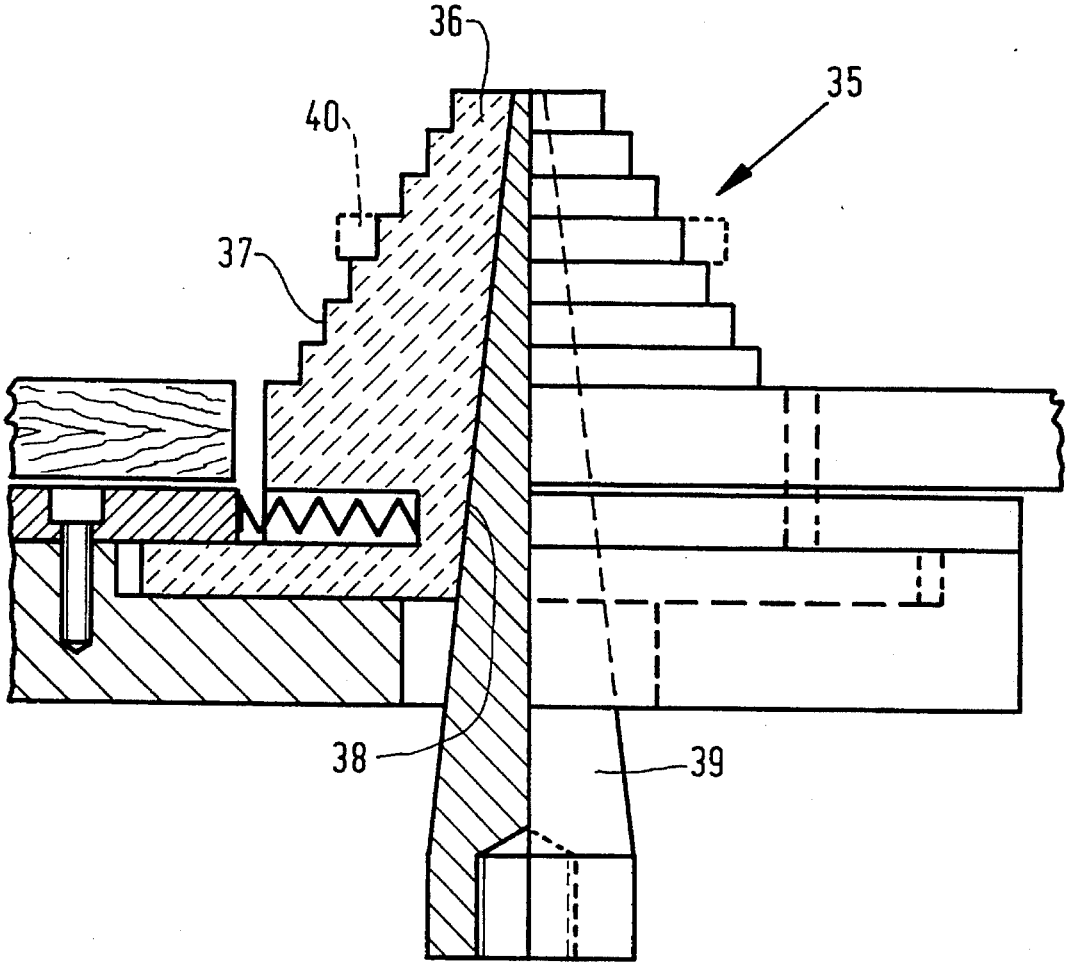
FIG. 5 depicts an advantageous embodiment of the tooling with which the outflow element depicted in FIG. 3 can be fabricated.

The collar 30 is already formed prior to the aforementioned actions. This can be done in a known manner by pushing a widening tool through a hole which is present in the plate. The bulge 28 in the pipe 23 is also introduced in to the pipe prior to these actions. FIG. 5 depicts a variant of the tooling shown in FIG. 4. The tooling 35 shown herein comprises a segmented core 36 with a stepped outer wall 37 and a tapering converging inner wall 38. A displaceable spline 39 is present within the inner wall, wherein the spine pushes the segments outwards during displacement. A ring 40 that is to be expanded is placed on one of the segmented steps of the outer wall, wherein the step chosen depends on the inner diameter of the ring 40. During the displacement of the spline 39, the ring is stretched in diameter following introduction into the outflow element in the same manner as indicated in FIGS. 3 and 4.

What is claimed is:

1. A method for fabricating an outflow element comprising an outlet pipe having a diameter and two or more inwardly projecting bulges at an end thereof, a plate having a hole with a diameter smaller than the diameter of the outlet pipe, and a clamping tube, all of which are to be permanently fixed together, the method comprising the following steps:

placing the plate at the end of the outlet pipe;

providing a widening tool having a cylindrical central portion and a conical end portion, the cylindrical central portion having a diameter greater than the diameter of the hole in the plate;

placing the clamping tube on the cylindrical portion of the widening tool; and pressing the conical portion of the widening tool through the hole in the plate and into the end of the outlet pipe, thereby widening and forming a collar around the hole in the plate and clamping the collar between the clamping tube and the end of the outlet pipe, with the collar pressed and held against the bulges in the outlet pipe.

2. A method for fabricating an outflow element comprising an outlet pipe having an internal diameter and an outwardly projecting circumferential bulge at a first end thereof, a plate having a hole with a protruding collar having an external diameter which is approximately the same as the internal diameter of the outlet pipe, and a clamping tube having a diameter, all of which are to be permanently fixed together, the method comprising the following steps:

placing the collar of the plate within the first end of the outlet pipe, such that the collar contacts the first end of the outlet pipe;

placing the clamping tube on a segmented tube disposed within the collar at the position of the circumferential bulge in the outlet pipe; and pushing a spline into the segmented tube towards a second end of the outlet pipe, thereby enlarging the diameter of the clamping tube and clamping the collar between the clamping tube and the first end of the outlet pipe, with the collar pressed into and held within the circumferential bulge in the outlet pipe.

* * * * *